US011462162B1

(12) United States Patent
Heganovic

(10) Patent No.: US 11,462,162 B1
(45) Date of Patent: Oct. 4, 2022

(54) HIGH CURRENT ACTIVE MATRIX PIXEL ARCHITECTURE

(71) Applicant: Sharp Display Technology Corporation, Kameyama (JP)

(72) Inventor: Adnan Heganovic, Oxford (GB)

(73) Assignee: Sharp Display Technology Corporation, Kameyama (JP)

( * ) Notice: Subject to any disclaimer, the term of this patent is extended or adjusted under 35 U.S.C. 154(b) by 0 days.

(21) Appl. No.: 17/335,303

(22) Filed: Jun. 1, 2021

(51) Int. Cl.
*G09G 3/3233* (2016.01)

(52) U.S. Cl.
CPC ..... *G09G 3/3233* (2013.01); *G09G 2300/043* (2013.01); *G09G 2300/0819* (2013.01); *G09G 2300/0842* (2013.01); *G09G 2310/0291* (2013.01)

(58) Field of Classification Search
CPC ..... G09G 3/3233; G09G 2300/043; G09G 2300/0819; G09G 2300/0842; G09G 2310/0291
See application file for complete search history.

(56) References Cited

U.S. PATENT DOCUMENTS 7,414,599 B2 8/2008 Chung et al.
2007/0080908 A1* 4/2007 Nathan ..... G09G 3/325 345/77
2008/0225023 A1* 9/2008 Shimizu ..... G09G 3/3233 345/204
2008/0238327 A1* 10/2008 Cho ..... G09G 3/3241 315/169.3
2009/0040173 A1* 2/2009 Ezaki ..... H05B 45/20 345/102
2009/0128055 A1* 5/2009 Shin ..... H05B 31/50 315/301
2009/0243512 A1* 10/2009 Nagumo ..... B41J 2/45 315/294
2011/0215727 A1* 9/2011 Liu ..... H05B 45/10 315/210
2014/0152180 A1* 6/2014 Wolf ..... H05B 47/24 315/122
2016/0095181 A1* 3/2016 Schiappelli ..... H05B 45/44 315/210
2016/0307503 A1* 10/2016 Song ..... G09G 3/3291
2016/0316537 A1* 10/2016 Schiappelli ..... H05B 45/397
2017/0162125 A1* 6/2017 Liang ..... G09G 3/3233
(Continued)

*Primary Examiner* — Jeff Piziali
(74) *Attorney, Agent, or Firm* — Renner, Otto, Boisselle & Sklar, LLP

(57) ABSTRACT

A pixel circuit operates to output a high drive current for high-current display applications by operating the drive transistor in the triode region. To maintain operation of the drive transistor in the triode region in a stable manner, the source-drain voltage dependence of the output current of the drive transistor is compensated with a bias transistor, which keeps the drain voltage of the drive transistor constant at a target drain voltage. The bias transistor is controlled by an operational amplifier (Opamp) running a negative feedback loop to ensure a fixed target voltage occurs at the drain of the drive transistor. To configure the negative feedback loop, the Opamp output terminal is connected to the gate of the bias transistor, with the negative terminal being connected to the drain of the drive transistor and the positive terminal being connected to a voltage supply line that supplies the target voltage.

13 Claims, 2 Drawing Sheets

(56) References Cited

U.S. PATENT DOCUMENTS

| | | | | |
|---|---|---|---|---|
| 2018/0332678 | A1* | 11/2018 | Navabi-Shirazi | H05B 45/10 |
| 2019/0057650 | A1* | 2/2019 | Choi | G09G 3/3233 |
| 2019/0059136 | A1* | 2/2019 | Navabi-Shirazi | H05B 45/10 |
| 2019/0215924 | A1* | 7/2019 | Navabi-Shirazi | G09G 3/3406 |
| 2021/0321501 | A1* | 10/2021 | Zhu | H05B 45/355 |
| 2021/0385924 | A1* | 12/2021 | Seminara | H05B 45/397 |

* cited by examiner

HIGH CURRENT ACTIVE MATRIX PIXEL ARCHITECTURE

TECHNICAL FIELD

The present application relates to design and operation of electronic circuits for delivering electrical current to an element in a display device, such as for example to an organic light-emitting diode (OLED) in the pixel of an active matrix OLED (AMOLED) display device.

BACKGROUND ART

Organic light-emitting diodes (OLED) generate light by re-combination of electrons and holes, and emit light when a bias is applied between the anode and cathode such that an electrical current passes between them. The brightness of the light is related to the amount of the current. If there is no current, there will be no light emission, so OLED technology is a type of technology capable of absolute blacks and achieving almost "infinite" contrast ratio between pixels when used in display applications. Similar display technologies may employ other types of light-emitting devices, including for example micro LEDs and quantum dot LEDs.

Several approaches are taught in the prior art for pixel thin film transistor (TFT) circuits to deliver current to an element of a display device, such as for example an organic light-emitting diode (OLED), through a p-type drive transistor. In one example, an input signal, such as a low "SCAN" signal, is employed to switch transistors in the circuit to permit a data voltage, VDAT, to be stored at a storage capacitor during a programming phase. When the SCAN signal is high and the switch transistors isolate the circuit from the data voltage, the VDAT voltage is retained by the capacitor, and this voltage is applied to a gate of a drive transistor. With the drive transistor having a threshold voltage $V_{TH}$, the amount of current to the OLED is related to the voltage on the gate of the drive transistor by:

$$I_{OLED} = \frac{\beta}{2}(V_{DAT} - V_{DD} - V_{TH})^2$$

where $V_{DD}$ is a power supply connected to the source of the drive transistor.

TFT device characteristics, especially the TFT threshold voltage $V_{TH}$, may vary with time or among comparable devices, for example due to manufacturing processes or stress and aging of the TFT device over the course of operation. With the same VDAT voltage, therefore, the amount of current delivered by the drive TFT could vary by a significant amount due to such threshold voltage variations. Therefore, pixels in a display may not exhibit uniform brightness for a given VDAT value.

Conventionally, therefore, OLED pixel circuits have high tolerance ranges to variations in threshold voltage and/or carrier mobility of the drive transistor by employing circuits that compensate for mismatch in the properties of the drive transistors. For example, an approach is described in U.S. Pat. No. 7,414,599 (Chung et al., issued Aug. 19, 2008), which describes a circuit in which the drive TFT is configured to be a diode-connected device during a programming period, and a data voltage is applied to the source of the drive transistor. The threshold compensation time is decided by the drive transistor's characteristics, which may require a long compensation time for high compensation accuracy.

For the data programming time, the RC constant time required for charging the programming capacitor is determinative of the programming time. As is denoted in the art, the one horizontal (1H) time is the time that it takes for the data to be programmed for one row. In some configurations, such as in the circuit configuration of U.S. Pat. No. 7,414,599, the data is programmed at the same time as when the threshold voltage of the drive transistor is compensated.

In certain display configurations, such as for example high power applications and other display configurations that may use certain types of LEDs as the light-emitting device, a relatively high operating current is desired to drive the light-emitting device. The amount of current at which a conventional light-emitting pixel can be driven is a function of the saturation voltage of the drive transistor, the light-emitting device voltage for light emission, and the driving supply voltage. For very high operating currents, the saturation voltage of the drive transistor increases to a point where the power arising from the current through the drive transistor is being mainly consumed in the drive transistor itself. As such, the current supplied to the light-emitting device becomes limited, which is undesirable for high current applications as the driving current to the light-emitting device is insufficient for peak performance. Conventional pixel circuit configurations, therefore, have proven deficient for high current display applications because of limitations arising out of the saturation voltage of the drive transistor.

SUMMARY OF INVENTION

The present application relates to pixel circuits that are able to output relatively high drive currents for high-current display applications as compared to conventional pixel circuit configurations. This provides enhanced performance in display applications that require higher driving or operating currents. As referenced above, the amount of current at which a conventional light-emitting pixel can be driven is a function of the saturation voltage of the drive transistor, the light-emitting device voltage for light emission, and the driving supply voltage. For high current applications, the saturation voltage of the drive transistor increases to a point where the power arising from the current through the drive transistor is being mainly consumed in the drive transistor itself. As such, the current supplied to the light-emitting device becomes limited, which is undesirable for high-current applications as the driving current to the light-emitting device is insufficient for peak performance.

The circuit configuration described in the current application reduces the undesirable power consumption in the drive transistor by operating the drive transistor in the triode region in which the drive transistor functions more like a voltage-controlled resistor, whereby the current through the drive transistor essentially is linearly proportional to the source-drain voltage across the drive transistor. By operating the drive transistor in the triode region, saturation limitations of conventional configurations are avoided, resulting in a much lower power consumption in the drive transistor at higher operating currents. In this manner, more power goes toward driving the light-emitting device for light emission, which provides enhanced performance for high-current display applications.

When operating the drive transistor in the triode region, an issue arises from the interdependence of the current through the drive transistor and the source-drain voltage across the drive transistor. Such interdependence could result in current fluctuations to the light-emitting device, which would undermine the light emission. To maintain operation of the drive transistor in the triode region in a stable manner, the source-drain voltage dependence of the output current of the drive transistor is compensated with a bias transistor, which keeps the drain voltage value of the drive transistor constant at a target drain voltage value. The bias transistor is controlled by an operational amplifier (Opamp) running a negative feedback loop to ensure a fixed target voltage occurs at the drain of the drive transistor. One Opamp can be shared among multiple pixels, or an Opamp can be provided in each pixel circuit individually.

An aspect of the invention, therefore, is a pixel circuit for a display device and related method of circuit operation that is enhanced for high-current display applications by operating the drive transistor in the triode region. In exemplary embodiments, the pixel circuit incudes a drive transistor configured to control an amount of current to a light-emitting device during an emission phase depending upon a voltage applied to a gate of the drive transistor, the drive transistor having a first terminal and a second terminal and the first terminal of the drive transistor is electrically connected to a first voltage supply line during the emission phase; a light-emitting device that is electrically connected at a first terminal to the second terminal of the drive transistor during the emission phase and is connected at a second terminal to a second voltage supply line; a bias transistor having a first terminal connected to the second terminal of the drive transistor and a second terminal that is electrically connected to the first terminal of the light-emitting device during the emission phase; and an operational amplifier (Opamp) having an output terminal that is connected to a gate of the bias transistor, and the Opamp is connected in a negative feedback loop configuration to fix a voltage at the second terminal of the drive transistor to a target voltage during the emission phase.

Performing the emission phase during which light is emitted from the light-emitting device includes operating the Opamp in a negative feedback loop to fix a voltage at the second terminal of the drive transistor to the target voltage; electrically connecting the first terminal of the drive transistor to the first voltage supply line to apply the first voltage supply to the first terminal of the drive transistor; and electrically connecting the first terminal of the light-emitting device to the second terminal of the drive transistor through the bias transistor, thereby applying the first voltage supply to the light-emitting device. The first terminal of the drive transistor may be a source of the drive transistor, and the second terminal of the drive transistor may be a drain of the drive transistor.

To the accomplishment of the foregoing and related ends, the invention, then, comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

DESCRIPTION OF EMBODIMENTS

Figure 1:
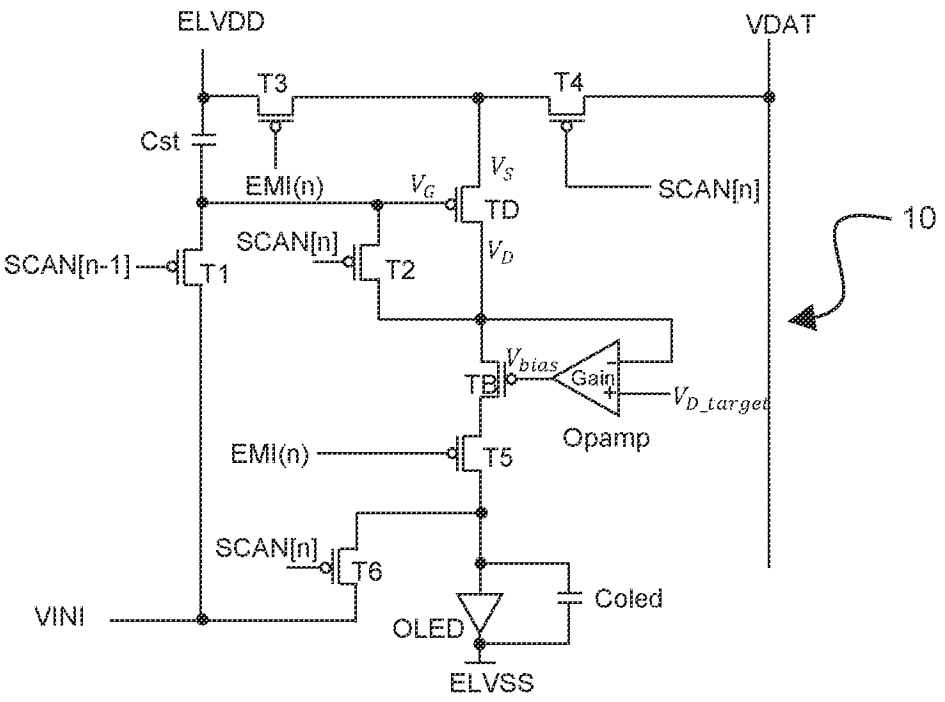
FIG. 1 is a drawing depicting a circuit configuration in accordance with embodiments of the present application.

Embodiments of the present application will now be described with reference to the drawings, wherein like reference numerals are used to refer to like elements throughout. It will be understood that the figures are not necessarily to scale.

Figure 2:
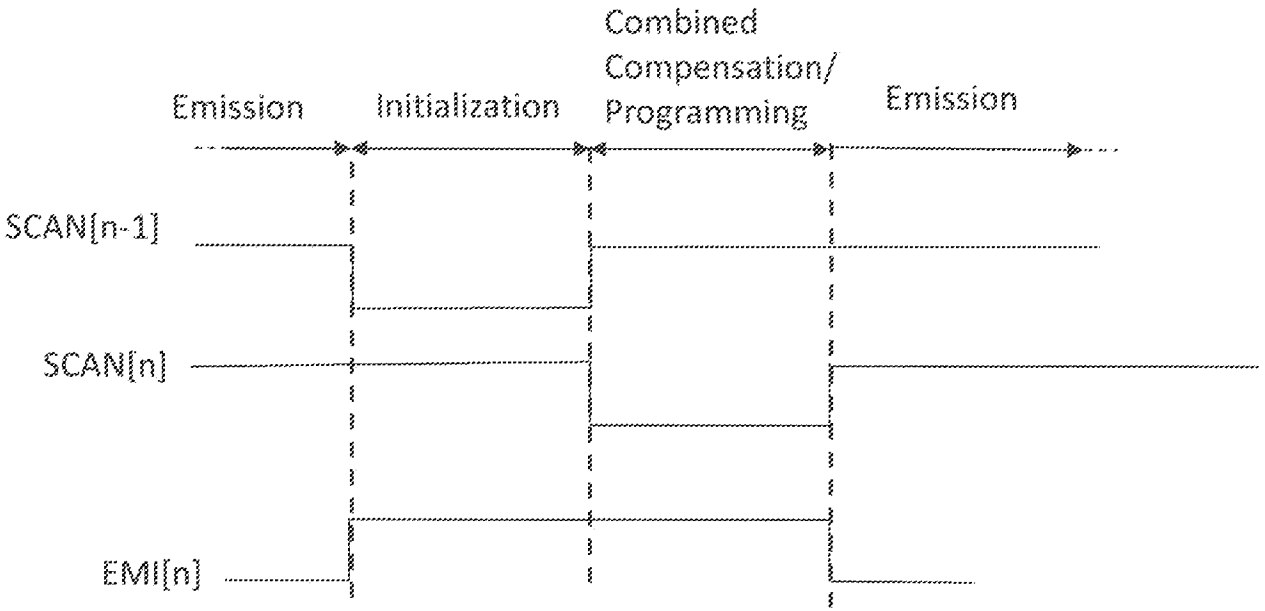
FIG. 2 is a drawing depicting a timing diagram associated with the operation of the circuit of FIG. 1.

FIG. 1 is a drawing depicting a pixel circuit configuration 10 in accordance with embodiments of the present application, and FIG. 2 is a timing diagram associated with the operation of the pixel circuit configuration 10 of FIG. 1. In this example, the pixel circuit 10 is configured as a thin film transistor (TFT) circuit that includes multiple p-type transistors TB, TD, T1, T2, T3, T4, T5, T6, a storage capacitor Cst, and an operational amplifier (Opamp). The circuit elements drive a light-emitting device, such as for example an organic light-emitting diode (OLED) device. The light-emitting device (OLED) has an associated internal capacitance, which is represented in the circuit diagram as $C_{oled}$. In addition, although the embodiments are described principally in connection with an OLED as the light-emitting device, comparable principles may be used with display technologies that employ other types of light-emitting devices, including for example micro LEDs and quantum dot LEDs.

More specifically, FIG. 1 depicts the TFT pixel circuit 10 configured with multiple p-MOS or p-type TFTs. Transistor TD is a drive transistor that is an analogue TFT, and first through sixth transistors T1-T6 are digital switch TFTs. As indicated in FIG. 1, the drive transistor has a drain terminal, a gate terminal, and a source terminal, with the respective drain, gate, and source terminals being identified respectively in FIG. 1 as $V_D$, $V_G$, and $V_S$. Transistor TB is referred to as a bias transistor and is an analogue TFT that functions as a variable resistor. As further detailed below, the Opamp outputs a bias voltage Vbias that controls the drain voltage at the drain of the drive transistor via the resistance of bias transistor TB. As referenced above, Cst and $C_{oled}$ are capacitors, with Cst also being referred to as the storage capacitor. $C_{oled}$ is the internal capacitance of the OLED device (i.e., $C_{oled}$ is not a separate component, but is inherent to the OLED). The OLED further is connected to a voltage supply line that supplies an input voltage ELVSS as is conventional.

The OLED and the pixel circuit 10, including the transistors, capacitors and connecting wires, may be fabricated using TFT fabrication processes conventional in the art. It will be appreciated that comparable fabrication processes may be employed to fabricate the TFT circuits according to any of the embodiments.

For example, the TFT circuit 10 may be disposed on a substrate such as a glass, plastic, or metal substrate. Each TFT may comprise a gate electrode, a gate insulating layer, a semiconducting layer, a first electrode, and a second electrode. The semiconducting layer is disposed on the substrate. The gate insulating layer is disposed on the semiconducting layer, and the gate electrode may be disposed on the insulating layer. The first electrode and second electrode may be disposed on the insulating layer and connected to the semiconducting layer using vias. The first electrode and second electrode respectively may commonly be referred to as the "source electrode" and "drain electrode" of the TFT. The capacitors each may comprise a first electrode, an insulating layer and a second electrode, whereby the insulating layer forms an insulating barrier between the first and second electrodes. Wiring between components in the circuit, and wiring used to introduce signals to the circuit (e.g. SCAN, EMI, VINI, and VDAT) may comprise metal lines or a doped semiconductor material. For example, metal lines may be disposed between the substrate and the gate electrode of a TFT, and connected to electrodes using vias. The semiconductor layer may be deposited by chemical vapour deposition, and metal layers may be deposited by a thermal evaporation technique.

The OLED device may be disposed over the TFT circuit. The OLED device may comprise a first electrode (e.g. anode of the OLED), which is connected to transistors T5 and T6 in this example, one or more layers for injecting or transporting charge (e.g. holes) to an emission layer, an emission layer, one or more layers for injecting or transporting electrical charge (e.g. electrons) to the emission layer, and a second electrode (e.g. cathode of the OLED), which is connected to voltage supply ELVSS in this example. The injection layers, transport layers and emission layer may be organic materials, the first and second electrodes may be metals, and all of these layers may be deposited by a thermal evaporation technique.

Referring to the TFT pixel circuit 10 of FIG. 1 in combination with the timing diagram of FIG. 2, the TFT pixel circuit 10 operates to perform in three phases: an initialization phase, a combined threshold compensation and data programming phase, and an emission phase for light emission. For this example and in related embodiments, display pixels are addressed by row and column. The current row is row n. The previous row is row n−1, and the second previous row is n−2. The next row is row n+1, and the row after that is row n+2, and so on for the various rows as they relate to the corresponding control signals identified in the figures. Accordingly, for example, SCAN(n) refers to the scan signal at row n and SCAN(n−1) refers to the scan signal at row n−1, and the like. EMI(n) refers to the emission signal at row n and the like, and so on for the various control signals. In this manner, for the various embodiments the input signals correspond to the indicated rows.

As seen in the circuit configuration of FIG. 1, the drive transistor TD has a first terminal (e.g., source) and a second terminal (e.g., drain) opposite from the first terminal, with the first and second terminals being respectively denoted as source $V_S$ and drain $V_D$. The gate of the drive transistor is denoted as $V_G$. As illustrated in the timing diagram of FIG. 2, during the previous emission phase, the EMI(n) signal has a low voltage value, so switch transistors T3 and T5 are in an on state, and light emission is being driven by the input driving voltage ELVDD being electrically connected to the first terminal of the drive transistor TD through T3, whereby the actual current applied to the OLED is determined by the voltage between the gate and the source of the drive transistor. As further detailed below, the current applied to the OLED also is determined by the source-drain voltage of the drive transistor, and the bias transistor TB sets the drain voltage of the drive transistor to a fixed target voltage value to ensure a constant and stable current flow through the drive transistor and to the OLED. Also from the previous emission phase, the SCAN signal levels for the applicable rows initially have a high voltage value so switch transistors T1, T2, T4, and T6 are all in an off state.

The initialization phase is performed to initialize the various circuit voltages, such as voltages at the storage capacitor and the drive transistor, to remove effects of previous frames. At the beginning of the initialization phase, the EMI(n) signal level is changed from a low voltage value to a high voltage value, causing switch transistors T3 and T5 to be placed in the off state. Switch transistor T3 has a first terminal connected to an input voltage supply line that supplies the input driving voltage ELVDD, and a second terminal connected to the first terminal (source) of the drive transistor. Switch transistor T5 has a first terminal connected to the bias transistor and that is electrically connected to the second terminal (drain) of the drive transistor during the emission phase, and a second terminal connected to the first terminal of the light-emitting device. As transistors T3 and T5 are turned off, the drive transistor is electrically disconnected from the driving voltage supply ELVDD and is electrically disconnected from the light-emitting device OLED.

Also during the initialization phase, the SCAN(n−1) signal level is changed from a high voltage value to a low voltage value, which places switch transistor T1 in an on state. As to the circuit components, the storage capacitor Cst has a first plate connected to the input voltage supply line that supplies the input driving voltage ELVDD, and a second plate connected to the gate of the drive transistor. Switch transistor T1 has a first terminal connected to the gate of the drive transistor and the second plate of the storage capacitor, and a second terminal connected to an initialization voltage supply line that supplies an initialization voltage VINI. With switch transistor T1 turning on, VINI is applied to the gate of the drive transistor and to the second plate of the storage capacitor through T1. The drive transistor's gate voltage (which also is the voltage at the second plate of the storage capacitor) from the previous frame is therefore reset, and the drive transistor is initialized to a low gate voltage which is required for the subsequent combined threshold compensation and data programming phase. Toward the end the initialization phase, the signal SCAN(n−1) is changed from a low voltage value to a high voltage value, which places switch transistor T1 in the off state to isolate the gate of the drive transistor from the initialization voltage supply line.

The pixel circuit next is operable in a combined threshold compensation and data programming phase, during which a threshold voltage of the drive transistor is compensated and a data voltage value for light emission is programmed to the pixel circuit. The signal SCAN(n) is changed from a high voltage value to a low voltage value, which places switch transistors T2, T4, and T6 in an on state. Switch transistor T6 has a first terminal connected to the initialization voltage supply line that supplies the initialization voltage VINI, and a second terminal connected to the first terminal of the light-emitting device. With T6 turning on, VINI is applied to the first terminal of the light-emitting device through T6, which resets or initializes the voltage at the light-emitting device to remove any effects from the previous frame.

Switch transistor T2 has a first terminal connected to the gate of the drive transistor, which is also connected to the second plate of the storage capacitor, and a second terminal connected to the second terminal (drain) of the drive transistor. As transistor T2 is turned on, the gate and second terminal (drain) of the drive transistor TD are electrically connected to each other through switch transistor T2, and the drive transistor TD becomes diode-connected. Diode-connected refers to the drive transistor TD being operated with its gate and another terminal (e.g., source or drain) being electrically connected to each other, such that current flows in one direction. In addition, switch transistor T4 has a first terminal connected to a data voltage supply line that supplies the data voltage VDAT, and a second terminal connected to the first terminal (source) of the drive transistor. As transistor T4 is turned on, the data voltage supply line is electrically connected to the first terminal (source) of the drive transistor, and thus the data voltage value VDAT is applied to the first terminal of the drive transistor through T4. With such operation, the source-gate voltage of the drive transistor is:

$$V_{SG}=V_{DAT}-V_{VINI}$$

Since the gate node $V_G$ of the drive transistor is floating, the drive transistor TD will inject a current into the node $V_G$ until the gate voltage of the drive transistor is high enough to turn off the drive transistor which permits threshold voltage compensation of the drive transistor. The voltage on the gate node $V_G$ of the drive transistor for compensation, which again also corresponds to the second plate of the storage capacitor Cst, becomes:

$$V_G=V_{DAT}-V_{TH}$$

where $V_{TH}$ is the threshold voltage of the drive transistor TD. In this manner, the threshold voltage of the drive transistor and the data voltage value effectively are stored by the storage capacitor Cst.

Preferably, to have effective voltage threshold compensation of the drive transistor TD, the initial voltage difference between the gate and the source of the drive transistor should be:

$$V_{DAT}-V_{VINI}>|V_{TH}|+\Delta V$$

where ΔV is a voltage that is large enough to generate a high initial current to charge the storage capacitor within an allocated threshold compensation time. The value of ΔV will depend on the properties of the transistors. For example, ΔV would be at least three volts for exemplary IGZO and LTPS thin film transistor processes. The voltages ELVDD and VINI, are set to satisfy this voltage requirement. The voltage stored on the storage capacitor $C_{st}$ is:

$$V_{Cst}=V_{ELVDD}-V_{DAT}+V_{TH}$$

Again, therefore, the threshold voltage of the drive transistor and the data voltage value effectively are stored by the storage capacitor Cst.

At the end of the combined threshold compensation and data programming phase, the signal SCAN(n) is changed from a low voltage value to a high voltage value, which places switch transistors T2, T4, and T6 in an off state. With such transistors turning off, the drive transistor TD is no longer diode connected and the drive transistor source is electrically isolated from the data voltage supply line VDAT, and the light-emitting device is electrically isolated from the initialization voltage supply line VINI.

The pixel circuit next is operable in an emission phase during which light is emitted by the light-emitting device. In general, to enhance usage in high-current applications, the drive transistor TD is operated in the triode region in which the drive transistor functions more like a voltage-controlled resistor, whereby the current through the drive transistor essentially is linearly proportional to the source-drain voltage across the drive transistor. By operating the drive transistor in the triode region, saturation limitations of conventional configurations are avoided, and a higher current can be supplied to the light-emitting device for light emission. As referenced above, however, when operating the drive transistor in the triode region an issue arises from the interdependence of the current through the drive transistor and the source-drain voltage across the drive transistor. Such interdependence could result in current fluctuations to the light-emitting device, which would undermine the light emission. To maintain operation of the drive transistor in the triode region in a stable manner in which the current does not fluctuate, the source-drain voltage dependence of the output current of the drive transistor is compensated with a bias transistor TB, which keeps the drain voltage of the drive transistor constant at a target drain voltage value. The bias transistor TB is controlled by an operational amplifier (Opamp) connected in a negative feedback loop configuration to ensure a fixed target voltage occurs at the drain of the drive transistor. One Opamp can be shared among multiple pixels, or an Opamp can be provided in each pixel circuit individually.

Referring to the pixel circuit configuration 10 of FIG. 1, the bias transistor TB has a first terminal connected to the second terminal (drain) of the drive transistor and a second terminal connected to the first terminal of the switch transistor T5. As further detailed below, during the emission phase the second terminal of the bias transistor is electrically connected to the first terminal of the light-emitting device through T5 to provide current to the light-emitting device for light emission. As referenced above, the pixel circuit further includes the operational amplifier (Opamp), and a gate of the bias transistor TB is connected to an output terminal of the Opamp. The positive input terminal of the Opamp is connected to a fixed input voltage supply line that supplies a fixed voltage corresponding to a target drain voltage value of the drive transistor, such target drain voltage value being referred to as $V_{D\text{-}target}$. A suitable voltage value for $V_{D\text{-}target}$ may be a voltage close to ELVDD, such as for example a voltage value of ELVDD—1V or comparable. Generally, the voltage value of $V_{D\text{-}target}$ should be suitable when such voltage value is higher than VDAT, or ELVSS plus the voltage across the light-emitting device (ELVSS+$V_{OLED}$).

The negative terminal of the Opamp is connected to the second terminal (drain) of the drive transistor TD. When current flows through the drive transistor, a negative feedback loop operates via the Opamp output through the bias transistor TB to pull the drain voltage of the drive transistor at the drain terminal $V_D$ to fix the voltage at the second terminal (drain) of the drive transistor to the target voltage value $V_{D\text{-}target}$. By fixing the drain voltage of the drive transistor to the target drain voltage value $V_{D\text{-}target}$, the voltage across the drive transistor is stabilized and the drive transistor is operable in the triode mode without any propensity toward current fluctuations.

During the emission phase, the signal EMI(n) is changed from a low voltage value to a high voltage value, which places transistors T3 and T5 in an on state. With transistors T3 and T5 turning on, the first terminal (source) of the drive transistor is electrically connected to the input voltage supply line that supplies the input driving voltage ELVDD through T3, and the first terminal of the light-emitting device is electrically connected to the second terminal (drain) of the drive transistor through T5 and the bias transistor TB. A driving current, therefore, is supplied via ELVDD to the light emitting device through transistors T3, TD, TB, and T5. The gate-source voltage of the drive transistor is therefore identical with the voltage stored on the storage capacitor Cst, which is:

$$V_{SG}=V_{Cst}=V_{ELVDD}-V_{DATA}+V_{TH}$$

In this configuration the source-gate voltage of the drive transistor is chosen such that the drive transistor is operating in the triode region as referenced above. The following relations are satisfied for the drive transistor to be operating in the triode region.

$$V_{SG}-V_{TH}>V_{SD}$$

$$V_{ELVDD}-V_{DATA}>V_{ELVDD}-V_{D_{target}}$$

$$V_{DATA}<V_{D_{target}}$$

The target drain voltage can be set for triode region operation with the bias transistor TB if the following relations are true:

$$V_{ELVDD}-V_{ELVSS}-V_{OLED}>V_{SD}$$

$$V_{ELVDD}-V_{ELVSS}-V_{OLED}>V_{ELVDD}-V_{D_{target}}$$

$$V_{ELVSS}+V_{OLED}<V_{D_{target}}$$

With the above relations satisfied whereby the drive transistor is operated in the triode mode, the drive transistor now supplies a current to the light emitting device from the positive to the negative supply rail. The amount of current supplied by the drive transistor to the light-emitting device is:

$$I_{OLED}=\beta\left((V_{SG}-V_{TH})*V_{SD}+\frac{V_{SD}^2}{2}\right)$$

$$I_{OLED}=\beta\left((V_{ELVDD}-V_{DATA})*(V_{ELVDD}-V_{D_{target}})+\frac{(V_{ELVDD}-V_{D_{target}})^2}{2}\right)$$

where $$\beta=\mu_n\cdot C_{ox}\cdot\frac{W}{L},$$

$C_{ox}$ is the capacitance of the drive transistor gate oxide;
W is the width of the drive transistor channel;
L is the length of the drive transistor channel (i.e. distance between source and drain); and
$\mu_n$ is the carrier mobility of the drive transistor.

Accordingly, the current to the OLED does not depend on the threshold voltage of the drive transistor TD, and hence the current to the OLED device $I_{OLED}$ is not affected by threshold voltage variations of the drive transistor. In this manner, any variation in the threshold voltage of the drive transistor has been compensated. In addition, by operating the drive transistor in the triode region, a significantly higher operating current may be provided for operation of the pixel circuit as compared to convention configurations that are limited by drive transistor saturation, which provides enhanced operation for high-current display applications.

In the example of FIGS. 1 and 2, the transistors, including the drive transistor TD, the bias transistor TB, and the digital switch transistors T1-T6, are p-type transistors as illustrated in FIG. 1. In an alternative embodiment, the pixel circuit may be configured comparably using n-type transistors rather than p-type transistors. As is known in the art, the drive properties of an OLED or other type of light-emitting device may be more suitable for one or the other of p-type versus n-type transistors, and the principles of the present application are applicable to either type of configuration. The control signal levels depicted in the timing diagram of FIG. 2 would be basically comparable for an n-type transistor configuration, except with the high versus low voltage values modified as warranted for the operation of n-type transistors rather than p-type transistors.

Although the invention has been shown and described with respect to a certain embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

INDUSTRIAL APPLICABILITY

Embodiments of the present invention are applicable to many display devices to permit display devices of high resolution with effective threshold voltage compensation and true black performance. Examples of such devices include televisions, mobile phones, personal digital assistants (PDAs), tablet and laptop computers, desktop monitors, digital cameras, and like devices for which a high resolution display is desirable.

REFERENCE SIGNS LIST

T1-T6—switch transistors
TD—drive transistor
TB—bias transistor
OLED—organic light emitting diode (or generally light-emitting device)
Cst—storage capacitor
Coled—internal capacitance of OLED
$V_G$—gate of drive transistor in the pixel circuit
$V_S$—source of drive transistor in the pixel circuit
$V_D$—drain of drive transistor in the pixel circuit
VDAT—data voltage supply line or data voltage
ELVSS—voltage supply
ELVDD—voltage supply
VINI—initialization voltage supply line or initialization voltage
$V_{D\text{-}target}$—target drain voltage supply line or target drain voltage
SCAN/EMI—control signals

What is claimed is:

1. A pixel circuit for a display device comprising:

a drive transistor configured to control an amount of current to a light-emitting device during an emission phase depending upon a voltage applied to a gate of the drive transistor, the drive transistor having a first terminal and a second terminal and the first terminal of the drive transistor is electrically connected to a first voltage supply line during the emission phase;

the light-emitting device being electrically connected at a first terminal to the second terminal of the drive transistor during the emission phase and is connected at a second terminal to a second voltage supply line;

a bias transistor having a first terminal connected to the second terminal of the drive transistor and a second terminal that is electrically connected to the first terminal of the light-emitting device during the emission phase; and an operational amplifier (Opamp) having an output terminal that is connected to a gate of the bias transistor, and the Opamp is connected in a negative feedback loop configuration to fix a voltage at the second terminal of the drive transistor to a target voltage during the emission phase;

wherein:

a negative terminal of the Opamp is connected to the second terminal of the drive transistor, and a positive terminal of the Opamp is connected to an input voltage supply line that supplies the target voltage;

a storage capacitor having a first plate connected to the first voltage supply line and a second plate connected to the gate of the drive transistor, wherein during a combined threshold compensation and data programming phase, a threshold voltage of the drive transistor and a data voltage are stored by the storage capacitor;

a first switch transistor having a first terminal connected to the gate of the drive transistor and the second plate of the storage capacitor, and a second terminal connected to an initialization voltage supply line that supplies an initialization voltage, wherein when the first switch transistor is in an on state the gate of the drive transistor and the second plate of the storage capacitor are electrically connected to the initialization voltage supply line through the first switch transistor; and a second switch transistor having a first terminal connected to the gate of the drive transistor and a second terminal connected to the second terminal of the drive transistor and the negative terminal of the Opamp, wherein when the second switch transistor is in an on state the drive transistor becomes diode-connected such that the gate and the second terminal of the drive transistor are electrically connected to each other through the second switch transistor.

2. The pixel circuit of claim 1, wherein the first terminal of the drive transistor is a source of the drive transistor and the second terminal of the drive transistor is a drain of the drive transistor.

3. The pixel circuit of claim 1, further comprising a third switch transistor having a first terminal connected to the first voltage supply line and a second terminal connected to the first terminal of the drive transistor, wherein when the third switch transistor is in an on state the first terminal of the drive transistor is electrically connected to the first voltage supply line through the third switch transistor.

4. The pixel circuit of claim 3, further comprising a fourth switch transistor having a first terminal connected to a data voltage supply line that supplies the data voltage and a second terminal connected to the first terminal of the drive transistor, wherein when the fourth switch transistor is in an on state the first terminal of the drive transistor is electrically connected to the data voltage supply line through the fourth switch transistor.

5. The pixel circuit of claim 4, further comprising a fifth switch transistor having a first terminal connected to the second terminal of the bias transistor and a second terminal connected to the first terminal of the light-emitting device, wherein when the fifth switch transistor is in an on state the first terminal of the light-emitting device is electrically connected to the bias transistor through the fifth switch transistor.

6. The pixel circuit of claim 5, further comprising a sixth switch transistor having a first terminal connected to the initialization voltage supply line that supplies the initialization voltage and a second terminal connected to the first terminal of the light-emitting device, wherein when the sixth switch transistor is in an on state the first terminal of the light-emitting device is electrically connected to the initialization voltage supply line through the sixth switch transistor.

7. The pixel circuit of claim 1, wherein the transistors are p-type transistors.

8. The pixel circuit of claim 1, wherein the light-emitting device is one of an organic light-emitting diode, a micro light-emitting diode (LED), or a quantum dot LED.

9. A method of operating a pixel circuit for a display device comprising the steps of:

providing the pixel circuit comprising:

a drive transistor configured to control an amount of current to a light-emitting device during an emission phase depending upon a voltage applied to a gate of the drive transistor, the drive transistor having a first terminal and a second terminal and the first terminal of the drive transistor is electrically connectable to a first voltage supply line;

the light-emitting device being electrically connectable at a first terminal to the second terminal of the drive transistor and is connected at a second terminal to a second voltage supply line;

a bias transistor having a first terminal connected to the second terminal of the drive transistor and a second terminal that is electrically connectable to the first terminal of the light-emitting device; and an operational amplifier (Opamp) having an output terminal that is connected to a gate of the bias transistor, a negative terminal that is connected to the second terminal of the drive transistor, and a positive terminal that is connected to an input voltage supply line that supplies a target voltage; and performing the emission phase during which light is emitted from the light-emitting device comprising:

operating the Opamp in a negative feedback loop to fix a voltage at the second terminal of the drive transistor to the target voltage;

electrically connecting the first terminal of the drive transistor to the first voltage supply line to apply the first voltage supply to the first terminal of the drive transistor; and electrically connecting the first terminal of the light-emitting device to the second terminal of the drive transistor through the bias transistor, thereby applying the first voltage supply to the light-emitting device;

wherein:

a negative terminal of the Opamp is connected to the second terminal of the drive transistor, and a positive terminal of the Opamp is connected to an input voltage supply line that supplies the target voltage;

the pixel circuit further comprises a storage capacitor having a first plate connected to the first voltage supply line and a second plate connected to the gate of the drive transistor, the method further comprising performing a combined threshold compensation and data programming phase including storing by the storage capacitor a threshold voltage of the drive transistor and a data voltage;

the pixel circuit further comprises a first switch transistor having a first terminal connected to the gate of the drive transistor and the second plate of the storage capacitor, and a second terminal connected to an initialization voltage supply line that supplies an initialization voltage, the method further comprising performing an initialization phase including placing the first switch transistor is in an on state to apply the initialization voltage to the gate of the drive transistor and to the second plate of the storage capacitor through the first switch transistor;

the pixel circuit further comprises a second switch transistor having a first terminal connected to the gate of the drive transistor and a second terminal connected to the second terminal of the drive transistor and the negative terminal of the Opamp, and the combined threshold compensation and data programming phase further includes placing the second switch transistor is in an on state whereby the drive transistor becomes diode-connected such that the gate and the second terminal of the drive transistor are electrically connected to each other through the second switch transistor.

10. The method of operating a pixel circuit of claim 9, wherein the pixel circuit further comprises a third switch transistor having a first terminal connected to the first voltage supply line and a second terminal connected to the first terminal of the drive transistor;

wherein the emission phase further comprises placing the third switch transistor is in an on state to apply the first voltage supply to the first terminal of the drive transistor through the third switch transistor.

11. The method of operating a pixel circuit of claim 10, wherein the pixel circuit further comprises a fourth switch transistor having a first terminal connected to a data voltage supply line that supplies the data voltage and a second terminal connected to the first terminal of the drive transistor;

wherein the combined threshold compensation and data programming phase further includes placing the fourth switch transistor is in an on state to apply the data voltage to the first terminal of the drive transistor through the fourth switch transistor.

12. The method of operating a pixel circuit of claim 11, wherein the pixel circuit further comprises a fifth switch transistor having a first terminal connected to the second terminal of the bias transistor and a second terminal connected to the first terminal of the light-emitting device;

wherein the emission phase further includes placing the fifth switch transistor is in an on state to electrically connect the first terminal of the light-emitting device to the bias transistor through the fifth switch transistor.

13. The method of operating a pixel circuit claim 12, wherein the pixel circuit further comprises a sixth switch transistor having a first terminal connected to the initialization voltage supply line that supplies the initialization voltage and a second terminal connected to the first terminal of the light-emitting device;

wherein the combined threshold compensation and data programming phase further includes placing the sixth switch transistor in an on state to apply the initialization voltage to the first terminal of the light-emitting device through the sixth switch transistor.

* * * * *